United States Patent [19]

Gian

[11] Patent Number: 4,801,210

[45] Date of Patent: Jan. 31, 1989

[54] METHOD AND APPARATUS FOR CONTINUOUS MIXING OF SMALL, PRECISE QUANTITIES OF BULK MATERIALS WITH A LIQUID STREAM

[76] Inventor: Michael Gian, 1502 Kingsbury Rd., Garden City, Kans. 67846

[21] Appl. No.: 167,369

[22] Filed: Mar. 14, 1988

[51] Int. Cl.[4] ..... B01F 15/02; B01F 13/02

[52] U.S. Cl. ..... 366/156; 366/3; 366/10; 366/101; 406/47; 406/61

[58] Field of Search ..... 366/3, 5, 10, 11, 101, 366/102, 103, 150, 154, 156, 157, 107, 349; 406/46, 47, 61; 222/630

[56] References Cited

U.S. PATENT DOCUMENTS

| | | | |
|---|---|---|---|
| 1,864,947 | 2/1931 | Selfridge . | |
| 1,879,101 | 9/1932 | Coleman . | |
| 2,628,204 | 2/1953 | Gray . | |
| 3,026,094 | 3/1962 | True | 366/5 |
| 3,767,170 | 10/1973 | Morgenstern | 366/3 |
| 4,208,251 | 6/1980 | Rasmussen | 406/47 |
| 4,239,423 | 12/1980 | Sakamoto | 406/47 |
| 4,607,957 | 8/1986 | Johanning . | |

*Primary Examiner*—Robert W. Jenkins

*Attorney, Agent, or Firm*—Hovey, Williams, Timmons & Collins

[57] ABSTRACT

A continuous mixer is provided for combining bulk materials metered at a relatively slow rate into a liquid stream and is particularly useful for preparing an innoculant solution for treating feed pellets, seed or the like. The mixer has a vertical separation tube extending between a screw feeder and a mixing zone in a liquid conduit therebelow, and the tube is independently pressurized with air to substantially preclude ascent of liquids within the tube to ensure that all of the mixing occurs within the liquid line and to prevent the liquid from rising to a level sufficient for wetting the innoculants stored within a hopper adjacent the screw feeder. Air pressure within the tube is selectively adjustable in order to vary the spray produced by a nozzle at the end of the fluid conduit from a liquid stream essentially free of air to a finely dispersed fog which includes substantial quantities of air.

10 Claims, 1 Drawing Sheet

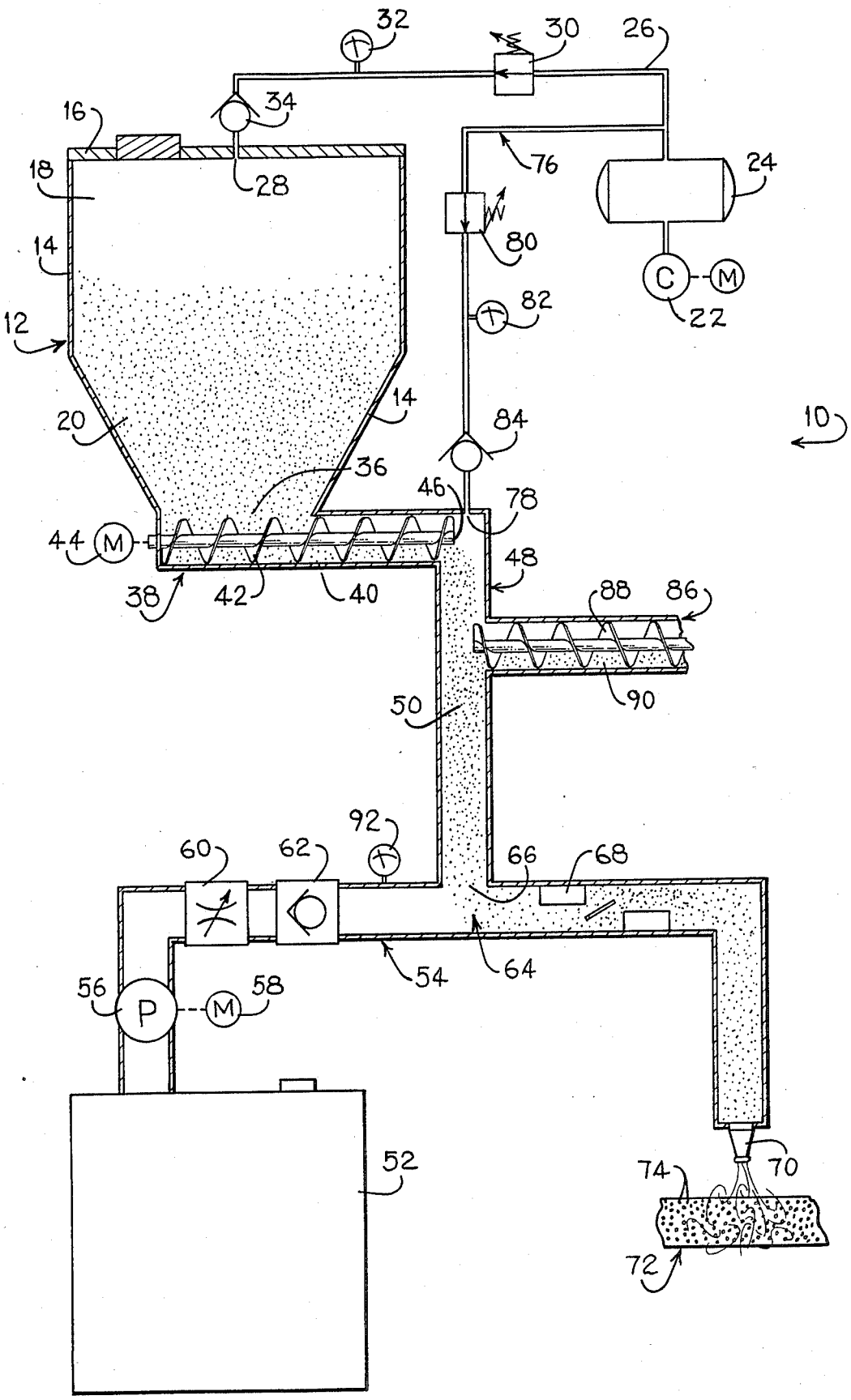
32
30
26
34
16
18
28
76
24
14
80
C
M
22
12
82
14
20
84
10
36
46
78
44
M
48
38
42
40
88
86
90
50
92
60
62
66
68
54
64
56
P
M
58
52
74
70
72

METHOD AND APPARATUS FOR CONTINUOUS MIXING OF SMALL, PRECISE QUANTITIES OF BULK MATERIALS WITH A LIQUID STREAM

BACKGROUND OF THE INVENTION

1. Field of the Invention

The present invention relates to methods and apparatus for mixing a small, steadily metered rate of bulk materials without wastage into a liquid stream, and is particularly useful for preparing an innocular solution for treating animal feed, seeds or the like.

2. Description of the Prior Art

In recent years, increased interest has been directed toward pelleted animal feeds which are treated with an innoculant of one type or another. Once ingested, the innoculant or bacteria live within the intestinal tract of the animal and produce lactic acid which prevents growth of harmful types of microorganisms that might otherwise cause digestive trouble.

It is possible to mix the innoculants with the various materials comprising the feed before pellitization. However, heat used during the pelletting process may seriously harm or kill the bacteria which normally is relatively expensive. Moreover, it is difficult for the average feedlot owner to test the pellets after formation to ensure that the bacteria are viable.

As a result, it has become common practice to mix innoculants with the feed after the pellet is formed. Typically, a quantity of bacterial powder is measured by hand and added to a tank containing a specific, measured quantity of oil. A stirrer within the tank is provided in an attempt to maintain the bacterial powder in suspension, and the tank is then pressurized to direct the mixture through a spray nozzle and onto previously formed feed pellets.

The use of oil such as mineral oil as a carrier for the innoculants is advantageous because the oil adheres to the pellets and essentially fixes the bacteria in place until ingested. Moreover, oil based carriers are superior to water based carriers in that the bacteria become activated once mixed with water and thus survive only a short time unless immediately fed to the animals.

Unfortunately, many problems have been associated with the use of batch type, pressurized mixing tanks for innoculation of feed pellets. First, the size of the batch must be estimated in advance so that a sufficient amount of mixture is available for treating the expected quantity of feed. Often, an amount of the oil and innoculant mixture in excess of the estimated needs is prepared so that treatment for all of the feed is somewhat assured. However, such practice normally leads to wastage of the relatively expensive innoculant material which cannot be saved in viable condition in the tank from one day to another.

On the other hand, it is particularly undesirable to underestimate the amount of oil and bacteria mixture for treating a quantity of feed due to the time and labor needed to precisely measure additional quantities of oil and innoculant powder for a second batch. Moreover, such practice increases the likelihood that either the oil or powder will be incorrectly measured.

Furthermore, batch type, pressurized tank mixing apparatus must be thoroughly cleaned after each use to prevent the growth of algae and other undesirable organisms. In essence, the interior walls of the tank, the stirrer and other components must be extensively scrubbed to remove all residue of the mixture.

Another problem associated with the mixing of oil and innoculants in a batch type tank is the tendency of the innoculants to settle. Use of a stirrer within the tank alleviates this problem somewhat, but it is difficult to attain a truly homogeneous mixture within all regions of the tank. As a result, portions of the mixture sprayed on the certain feed pellets may have a higher concentration of bacteria than other portions of the mixture applied to other pellets.

In some instances, it is desirable to mix three or four different chemicals or types of bacteria in an oil solution. In batch type mixing apparatus, however, the chemicals may react with each other if residence times in the tank exceed a certain value.

SUMMARY OF THE INVENTION

In order to overcome the disadvantages outlined above, I provide an instantaneous mixer for combining precise, metered quantities of dry bacterial powder with a liquid carrier such as oil. The apparatus is particularly useful for preparing an innoculant solution for treating feed pellets or seeds, and is also useful for other applications where small quantities of a dry substance must be mixed with a liquid.

More particularly, the mixing apparatus of the present invention comprises a pressurized hopper which receives the innoculants and a screw feeder at the bottom of the hopper to meter a small, steady rate of the innoculants out the bottom of the hopper, and to an upright separation column or tube. A lower end of the tube terminates in an upwardly facing opening of a mixing zone disposed within a fluid conduit for the oil, and a pump is provided for directing oil from a storage vessel along the length of the conduit and through the mixing zone.

Importantly, the separation tube has an upper inlet for admitting a steady stream of air to the tube independently of the air provided for pressurizing the hopper containing the innoculants. The air admitted to the separation tube facilitates acceleration and descent of the bacteria discharged from the screw feeder in cooperation with the effects of gravity. The conveying air directs the bacterial powder into the mixing zone and flows, along with the oil and powder, toward a nozzle for producing a finely dispersed spray in the nature of a fog for application to the feed pellets.

The air admitted to the vertical separation tube is pressurized to a degree greater than the pressure of liquid passing through the mixing zone. In this manner, the air substantially precludes ascent of the oil upwardly through the opening and into the separation tube where the oil might otherwise combine with portions of the innoculant in the feeder or possibly within the hopper. Moreover, the pressure of the air admitted to the separation tube is less than or equal to the pressure within the hopper to facilitate passage of the dry, bulk powder along the length of the screw.

In preferred forms of the invention, the air inlet of the vertical separation tube is disposed above the discharge end of the screw feeder in order to enhance disengagement of the powder from the screw. In other forms of the invention, two or more screw feeders extend into the separation tube from different hoppers so that a number of chemicals or innoculants may be combined within the tube and instantaneously mixed with the liquid stream therebelow.

BRIEF DESCRIPTION OF THE DRAWING

The drawing is an essentially schematic illustration of one embodiment of a mixing apparatus constructed in accordance with the principles of my invention, with certain components shown in side cross-sectional view and with one of the screw feeders of the mixing apparatus illustrated in fragmentary form.

DETAILED DESCRIPTION OF THE DRAWING

An apparatus 10 as shown in the drawing for mixing precise quantities of bulk materials with a stream of liquid comprises a hopper 12 with upright, opposed walls 14 and a removable lid 16. The walls 14 and lid 16 together define an interior chamber 18 for receiving bulk materials such as innoculants 20 in dry powder or finely granular form. The hopper 12, when the lid 16 is in the closed position shown in the drawing, is leak resistant, so that the chamber 18 is pressurizable to a value above atmospheric. A means for pressurizing the chamber 18 includes an air compressor 22 that maintains a quantity of pressurized air within a storage tank 24 that, in turn, communicates with piping 26 which leads to an inlet 28 formed in lid 16.

Pressure of air within the chamber 18 from storage tank 24 is controlled by means of a regulator 30 interposed in piping 26. A gauge 32 is provided for monitoring the air pressure, and a check valve 34 prevents inadvertent flow of air out of the chamber 18 and back to tank 24.

The walls 14 of hopper 12 include upper, parallel sections as well as lower, inclined sections which extend toward each other and to a lower outlet 36 formed at the bottom of chamber 18. The outlet 36 communicates directly with an upper inlet of an elongated screw feeder 38 which includes a tubular housing 40 that surrounds an elongated, axially rotatable screw 42 presenting helical flighting. A variable speed motor 44 is coupled to screw 42 for rotation of the latter in order to carry away, in steadily metered fashion, portions of the innoculants 20 from the chamber 18.

The screw feeder 38 presents a discharge end portion 46 which is remote from the lower outlet 36 of the chamber 18 and which extends into an upper section of an upright, preferably vertical separation column or tube 48. As shown in the drawing, the tail end of the screw 42 extends past the cylindrical wall defining the tube 48 and into a central, upper portion of a passage 50 within the tube 48, so that the innoculant 20 are directly discharged into the tube 48 without accumulating on horizontal wall surfaces such as a lower wall portion of the screw feeder housing 40.

A vessel 52 for receiving and storing a quantity of liquid such as oil is connected to a fluid conduit 54. A pump 56, driven by motor 58, is operable to draw oil out of the vessel 52 and direct the oil along the length of the fluid conduit 54 under pressure. A valve 60 controls the flow rate of oil along the conduit 54, while a check valve 62 substantially prevents inadvertent, reverse flow of air in the opposite direction along fluid conduit 54 as will be further understood in the paragraphs that follow.

The fluid conduit 54 extends to a mixing zone 64 having an upwardly facing inlet opening 66. In preferred forms of the invention, the fluid conduit 54 directly upstream and downstream of the inlet opening 66 is of the same diameter as the diameter of the circular opening 66.

A number of vortex augmentation members 68 are disposed within the conduit 54 downstream of mixing zone 64. The fluid conduit 54 terminates in a nozzle 70 which may be hand-held or disposed in generally fixed relation to a conveyor belt 72 carrying a steady rate of feed pellets 74 therebelow.

An air conveying means for accelerating the innoculants 20 which are discharged from the end portion 46 of the screw feeder 38 includes piping 76 which is interconnected with the air storage tank 24 and an air inlet 78 disposed at the top of the vertical separation tube 48. The flow of air through the piping 76 is controlled by means of a pressure regulator 80, and monitored by a gauge 82. In addition, a check valve 84 is provided to prevent inadvertent reverse flow of air through piping 76 in a direction toward storage tank 24.

The air inlet 78 is advantageously disposed above the discharge end portion 46 of the screw feeder 38 for facilitating disengagement of the innoculants 20 from the end of screw 42. Air passing through the inlet 78 accelerates the innoculants 20 along the length of the tube passage 50 in cooperation with the effects of gravity directs the innoculants 20 through the inlet opening 66 leading into the mixing zone 64. Within zone 64, the innoculants 20 and a quantity of the air emitted from air inlet 78 mix with the passing stream of oil, and the innoculant, oil and air mixture is then directed, through the combined efforts of pump 56 and the pressure of air passing through inlet 78, to the nozzle 70 for spray discharge as a fog or mist. As such, air passing through the inlet 78 performs an important function in that the innoculants 20 are accelerated during passage along the length of tube 48 for immediate, instantaneous mixing with the liquid stream within the mixing zone 64, and thereafter the same air is utilized to provide a fog-like spray so that very small quantities of the bacterial powder may be used to uniformly treat a relatively large surface area of the feed pellets 74.

Furthermore, air passing through the air inlet 78 performs another essential function in that the pressure of the air prevents liquid from ascending through the inlet opening 66 and upwardly into the tube 48. Consequently, the tube 48 functions as a liquid/solid separator in order to keep the liquid away from the bacterial powder within screw feeder 38 and hopper chamber 18.

Advantageously, the pressure of air passing through the inlet 78 is slightly greater than the pressure of liquid passing through the fluid conduit 54 in the region of the mixing zone 64, so that all of the liquid remains below the inlet opening 66. As a result, all of the innoculant powder discharged from the screw feeder 38 is quickly mixed with the stream of liquid that flows through the fluid conduit 54, in order to avoid formation of stagnant pockets of liquid above the inlet opening 66 which might otherwise cause a variation in concentration of the innoculant powder of the liquid and air stream passing through nozzle 70.

In practice, good results have been attained when the pressure of air passing through the inlet 28 is equal to or slightly greater than the pressure of air passing through inlet 78. In this manner, the innoculants 20 within chamber 18 are steadily discharged through the lower outlet 36 and evenly metered by the screw 42 for passage along the length of the screw feeder 38. Further, it has been found that superior results are provided by use of the air inlet 78 at the top of tube 48 to provide the principal source of air to convey the particles through the tube 48 and fluid conduit 54, as opposed to attempts to introduce air only a the top of the innoculant storage hopper such as inlet 28.

The apparatus 10 is particularly useful for mixing relatively expensive powders with a liquid carrier, since the apparatus 10 may be readily shut down as soon as a sufficient quantity of mixture is prepared and sprayed without any substantial quantity of remaining, unused mixture. Normally, at the end of the spraying operation, motor 44 for the screw feeder 38 is deactivated, and an additional quantity of liquid is directed by pump 56 through conduit 54 in order to flush and clean the latter. As a consequence, the innoculant 20 may be stored within chamber 18 until needed for the next operation.

An important aspect of the apparatus 10 is the nature of the upright tube 48 which is preferably in a substantially vertical orientation. The upright tube 48 thus enables the influence of gravity to accelerate and move the innoculant particles along with the forces presented by the stream of incoming air, and the tube 48 is also therefore self-cleaning in the sense that there are no sloping or horizontal walls which might otherwise provide a surface for collecting the dry substances. Moreover, an increased amount of air and therefore energy would be necessary if, for example, such a tube were instead oriented in horizontal disposition.

Optionally, one or more additional screw feeders, such as screw feeder 86 as shown in the drawing, may be provided in order to simultaneously feed two or more different types of bulk materials such as innoculants into the tube 48 for instantaneous, continuous mixing with the liquid passing through fluid conduit 54. In the particular embodiment illustrated, screw feeder 86 extends through the vertical, cylindrical sidewall of tube 48 at a location below screw 42 in horizontal orientation parallel to the longitudinal axis of screw 42. The screw feeder 86 has an axially rotatable screw 88 with helical flighting for metering powders or granular substances such as innoculants 90 away from a pressurized storage hopper (not shown) which is similar in essential respects to hopper 12.

As can now be appreciated, the proportion or strength of the innoculants 20 relative to the (volumetric flow rate of liquid passing through the fluid conduit 54 may be varied as desired by adjustment of the speed of the screw motor 44, or alternatively by varying the setting of the fluid conduit valve 60. On the other hand, the amount of air intermixed with the liquid and innoculant mixture passing through nozzle 70 is adjustable by means of the pressure regulator 80, so that a spray discharge ranging from a fog to a relatively heavy mist can be provided. The latter feature is particularly desirable inasmuch as only a few grams, for example, of innoculants may be necessary for treatment of many tons of feed pellets.

Example 1

In this test, the screw feeder motor 44 was adjusted to introduce one-half gram of innoculant powder into the vertical separation tube 48 every minute, while the pump 56 directed 12.5 milliliters of mineral oil through fluid conduit 54 every minute. A total of one gallon of innoculant and oil mixture was prepared for every 25 tons of feed pellets 74 which were passing adjacent the nozzle 70 on the conveyor belt 72 at the rate of five tons per hour.

The air pressure in the chamber 18 and the separation tube 48 was maintained in the range of ten to fifteen psi, while the pressure of the liquid flowing through fluid conduit 54 as observed by gauge 92 was maintained at two or three psi less than the air pressure. In this instance, air admitted through inlet 78 was provided at a rate fast enough to assist the liquid in conveying the innoculants 20 along the conduit 54 downstream of the mixing zone 64 such that the spray emitted from the nozzle 70 was in the form of a light fog.

The vertical tube 48 in this case was a steel pipe of three-quarter inch nominal diameter. Good results were observed and the fog produced by nozzle 78 was sufficient to cover all of the feed pellets, but somewhat better coverage was obtained by increasing the rate of the innoculant/oil mixture to a value of three gallons for each 25 tons of feed pellets.

EXAMPLE 2

During this test, three grams of bacteria were discharged by the screw feeder 38 into the tube 48 for each one-half gallon of a water carrier pumped through the conduit 54. Each one-half gallon of the mixture exiting the mixing zone 64 was sprayed on one ton of feed pellets passing alongside nozzle 70 on conveyor belt 72. The vertical tube 48 was in the nature of a hose having an inner diameter of three-eighths inch.

In this test, pressure of the air admitted through inlet 78 was lowered somewhat so that essentially only water was used to convey the bacteria along conduit 54 and through nozzle 70 for providing a spray in the nature of a fine liquid mist substantially free of air. The pressure as observed by gauge 92 of the liquid in the conduit 54 was approximately 20–25 psi, and the regulator 80 was adjusted such that the pressure at the top of the tube 48 as observed by gauge 82 was about 30 psi. Inasmuch as the water provided substantially the entire force for conveying the bacterial powder through nozzle 70, the air was utilized only to maintain the vertical tube 48 in dry condition and prevent the water from reaching the innoculants stored within chamber 18 as well as those portions present within screw feeder 38.

I claim:

1. Apparatus for mixing precise quantities of bulk materials with a stream of liquid comprising:

means defining a hopper presenting an enclosed chamber for receiving bulk materials, said enclosed chamber having a lower outlet and being pressurizable to a value above atmospheric pressure;

means for pressurizing said chamber to a first, certain pressure;

an elongated, axially rotatable screw feeder extending through said outlet of said chamber for carrying away metered portions of said bulk materials from said chamber, said screw feeder presenting a discharge end portion remote from said outlet of said chamber;

a vessel for receiving and storing liquid;

conduit means coupled to said vessel and having an outlet opening remote from the latter;

means for pumping liquid from said vessel and along the length of said conduit means under pressure for discharge through said outlet opening, said conduit means including structure defining a mixing zone having an upwardly facing inlet opening;

an upright separation tube having an upper section for receiving bulk materials discharged from said end portion of said screw feeder, said tube including a lower section directly connected to said structure defining said mixing zone of said conduit means in surrounding relationship to said inlet opening; and air conveying means for accelerating bulk materials along substantially the length of said upright separation tube in cooperation with the effects of gravity and for directing said bulk materials through said inlet opening and into said mixing zone, said conveying means including means for pressurizing the tube at a pressure equal to or less than the pressure of said chamber and at a pressure which is greater than the pressure of said liquid passing through said mixing zone of said conduit means in order to substantially preclude ascent of said liquid through said inlet opening adjacent said mixing zone and into said upright tube, said means for pressurizing said tube including structure defining an air inlet disposed adjacent said discharge end portion of said screw in order to facilitate acceleration and descent of bulk materials along said separation tube.

2. The invention as set forth in claim 1, wherein said lower section of said tube presents a transverse, free cross-sectional internal area substantially equal to the internal, free cross-sectional area of said conduit means in said mixing zone.

3. The invention as set forth in claim 1, wherein said means for pressurizing said tube includes an air inlet disposed above said discharge end portion of said screw feeder for facilitating disengagement of bulk materials from the latter.

4. The invention as set forth in claim 1, wherein said screw feeder extends in a generally horizontal direction, and wherein said means for pressurizing said tube includes an air inlet disposed directly above said discharge end portion of said screw feeder.

5. The invention as set forth in claim 1; and including a second, elongated, axially rotatable screw feeder having a discharge end portion extending into said tube for metering additional quantities of said bulk materials into said tube.

6. The invention as set forth in claim 1, wherein said screw feeder includes a variable feed motor.

7. The invention as set forth in claim 1; and including means for inducing a vortex in said liquid stream passing through said fluid conduit at at least one location downstream of said mixing zone.

8. A method of mixing precise quantities of bulk materials with a liquid stream comprising the steps of:

loading a quantity of bulk materials into an enclosed, pressurized chamber;

metering a portion of said bulk materials out of said chamber with an elongated, axially rotatable screw feeder;

discharging the metered bulk materials from said screw feeder into an upper section of an upright tube; p1 pumping under pressure a volume of liquid through an elongated fluid conduit presenting a mixing zone with an upwardly facing inlet opening connected to a bottom section of said upright tube; and admitting pressurized air into said upper section of said upright tube adjacent a discharge end portion of said screw feeder to pressurize said tube to a value equal to or smaller than the pressure within said chamber and greater than the pressure within said fluid conduit of said mixing zone in order to facilitate advancement of said bulk materials along said screw feeder and descent of said materials along said tube while substantially precluding ascent of liquid within the latter.

9. The method as set forth in claim 8, wherein said step of admitting air to said upright tube includes the step of directing pressurized air in a direction generally toward said discharge end portion of said screw feeder.

10. The method as set forth in claim 8; and including the step of introducing bulk materials into said upright tube with another screw feeder presenting a discharge end portion disposed generally beneath the location where said air is admitted into said tube.

* * * * *